US006459768B1

(12) United States Patent
Koller et al.

(10) Patent No.: US 6,459,768 B1
(45) Date of Patent: Oct. 1, 2002

(54) X-RAY TUBE WINDOW AND FRAME

(75) Inventors: Thomas Koller, Salt Lake City, UT (US); Charles Lynn Chidester, West Bountiful, UT (US); Mark Alan Heber, Riverton, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 09/680,924

(22) Filed: Oct. 6, 2000

Related U.S. Application Data

(60) Provisional application No. 60/158,614, filed on Oct. 8, 1999.

(51) Int. Cl.[7] ..... H01J 35/18

(52) U.S. Cl. ..... 378/140; 378/121; 378/127; 378/161

(58) Field of Search ..... 378/121, 127, 378/140, 161; 313/59; 220/23; 250/505.1

(56) References Cited

U.S. PATENT DOCUMENTS 4,107,562 A * 8/1978 Koller et al. ..... 378/161
4,122,967 A * 10/1978 Rohrich ..... 220/2.3 R
4,159,437 A * 6/1979 Sahores ..... 378/140
5,056,126 A * 10/1991 Klostermann et al. ..... 378/121
5,161,179 A * 11/1992 Suzuki et al. ..... 228/194
5,173,612 A * 12/1992 Imai et al. ..... 250/505.1
5,585,644 A * 12/1996 Van Der Borst ..... 250/505.1

* cited by examiner

*Primary Examiner*—David P. Porta
*Assistant Examiner*—George Wang
(74) *Attorney, Agent, or Firm*—Workman, Nydegger & Seeley

(57) ABSTRACT

A method and apparatus for providing a window frame and window for use in an x-ray tube, wherein the new structure reduces deforming stresses on the window produced by pressure differential incident upon the window. The support structure of the window frame to which the window is attached is angled toward the interior of the x-ray tube to an angle equaling the deflection to which a window is typically subjected in standard window frames. A window mounted to a frame in accordance with the present invention is subjected to reduced or eliminated deforming stresses, even in high deflection stress environments including air bake x-ray tube manufacturing processes. This elimination of deforming stresses allows for the use of thinner x-ray tube windows enabling a higher transmissivity of produced x-rays.

30 Claims, 6 Drawing Sheets

43

X-RAY TUBE WINDOW AND FRAME

RELATED APPLICATION INFORMATION

This application claims priority to U.S. Provisional Application, application Ser. No. 60/158,614, filed on Oct. 8, 1999, the contents of which are incorporated herein in their entirety.

BACKGROUND OF THE INVENTION

1. The Field of the Invention

The present invention relates generally to x-ray tubes. More specifically, embodiments of the present invention relate to an improved x-ray tube window and frame that exhibit improved mechanical and x-ray transmission characteristics.

2. The Relevant Technology

X-ray tubes typically utilize an x-ray transmissive window formed in the housing of the x-ray tube that permits x-rays produced within the tube to be emitted. The window is typically set within a window frame, and is located in the side or in the end of the x-ray tube. The window is typically a disk-shaped plate comprised of beryllium or similar materials that are x-ray transmissive.

FIG. 1A is a simplified cross-sectional illustration of an x-ray tube 2 as used in the prior art having a window 4 positioned in an end of the x-ray tube. An x-ray tube housing 3 defines an evacuated enclosure 5 that encloses an electron source or cathode 13, and an anode 14. As is shown, the window 4 is affixed within the wall of the housing with a window frame 8, which is illustrated as being structurally integrated within the x-ray tube housing. The window 4 separates the vacuum of evacuated enclosure 5 of the x-ray tube from the normal atmospheric pressure found outside the tube, and yet enables x-rays generated from the anode 14 to exit the x-ray tube 2 and strike an intended target 16.

Although window thickness will vary depending on the particular x-ray tube application, windows are typically very thin, often measuring 0.08 millimeters or less. In particular, a window with a reduced thickness is generally desired so as to minimize the amount of x-rays that are absorbed by the window material during x-ray tube operation.

While a thinner window is desirable, a thin window affixed to a window frame that is integrally mounted to an x-ray tube housing is typically subjected to deforming stresses created as a result of the large pressure differential that exists on either side of the window. Such deforming stresses are non-uniformly distributed over the surface of the window and can produce cracking in the window and leaks between the window and the window frame. This can cause the x-ray tube housing to lose its vacuum, and render the x-ray device inoperable.

For example, FIG. 1B depicts a typical side mounted window-type x-ray tube 10 in cross section, having a window 12, cathode 13, anode 14, and intended target 16. The window 12 is depicted in phantom to illustrate its typical deformed state due to the pressure differential existing across its inner and outer surfaces. Again, this can result in cracking and consequent loss of vacuum.

FIG. 2A depicts a close-up cross-sectional view of a typical prior art window frame 20 of an x-ray tube 18, with a window 22 disposed therein. The window 22 is typically brazed or diffusion bonded to a support flange 21 of the window frame 20. The support flange 21 typically extends parallel to the plane in which window frame 20 is situated. The deflection of window 22 inward toward evacuated enclosure 26 (defined by x-ray tube housing 19) is caused, as mentioned earlier, by the pressure differential existing across the inner and outer surfaces of the window, which surfaces separate the vacuum tube interior from the normal atmospheric pressure exterior designated at 24. The deflection of the window 22 is especially apparent at the junction 28 of the support flange and the window,. and is the area that is subjected to a relatively higher level of mechanical stress.

FIG. 2B illustrates a view of the window 22 supported by window frame 20 from the perspective of lines A—A in FIG. 2A. The view further illustrates the area of junction 28 and the area of transition from where window 22 is supported by support flange 21, to the area where the window is not supported.

The deflection of window 22 worsens after x-ray tube 18 is processed in high temperature environments during tube manufacture. One example of such high temperature processing is air baking. This process involves heating the x-ray tube (with the window and windrow frame attached to the tube housing) to approximately 450 to 475 degrees Celsius for a given amount of time. This imposes a fair level of thermal stresses in the window area and, when combined with the stresses caused by the pressure gradient existing over the surfaces of window 22, further result in the surface of window 22 being. stressed and deformed inwardly toward evacuated enclosure 26. Again this can result in cracking of the window and air leaks into tube housing 18, and limit the operational life of the x-ray device.

One approach used to overcome this problem is. to increase the thickness of the window. Thicker windows are inherently stronger and less susceptible to stress and the resultant cracks. However, a thicker window is less transmissive to. x-rays, especially those of lower energy. This can be especially problematic in low power x-ray tubes.

Consequently, it would be an improvement over the state of the art to provide an x-ray tube window that suffers less from the effects of deforming stress, and yet maintain sufficient transmissivity to x-rays. Also, it would be desirable to provide a window frame that decreases the incidence of stress on the window mounted therein, thereby increasing the useful life of the x-ray tube. Further it would be an improvement to provide a window frame and window that can be assembled and manufactured in a manner that reduces the incidence of mechanical and thermal damage that traditionally occurs during the manufacturing process.

SUMMARY AND OBJECTS OF THE INVENTION

Given the problems present in currently available x-ray tubes, it is a primary objective to provide an x-ray tube that is more resistant to mechanical stresses present in an operating x-ray tube.

A related objective is to minimize the occurrence of cracks in the window and thereby prevent vacuum leaks from occurring.

Also, it is an objective to provide a method and apparatus that minimizes the degree of deforming stresses that are imposed on an x-ray tube window during certain manufacturing steps.

These and other objectives, features and advantages are provided in embodiments of the present invention, which are generally directed to a new x-ray tube window and window frame. In particular, the improved frame and window reduce bending/deflection stresses on the window.

In one presently preferred embodiment, a window frame is provided that utilizes a support flange for supporting the x-ray tube window. Preferably, the support flange is angled towards the evacuated enclosure cavity of the x-ray tube. In this way, the deflection to which the window is typically subjected is anticipated and compensated for, thereby reducing or eliminating deflection stresses that are otherwise imposed on the window as a result of pressure differentials and thermal stresses.

In one presently preferred embodiment, the support flange is oriented at an angle that is consistent with the degree of deflection that the window would otherwise experience in a deflected state. The angle of the window frame support flange is constructed such that at a given radial distance from the center of a window, the primary stress component acting on the window is tension, thus minimizing torsion or other bending stresses acting thereon.

This reduction in bending stress along the interface with the support flange minimizes the occurrence of cracks in the window, or along the attachment interface with the flange. This minimizes vacuum leakage, and results in an extended tube lifetime. Also, a reduction in stresses on the window make it possible for a thinner window to be utilized, thus enabling a higher level of x-ray transmission through the window. Also, an increased level of x-rays can be emitted from the x-ray tube without increasing the power level of the x-ray device.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to the drawings to describe in further detail presently preferred embodiments of the invention. It is to be understood that the drawings are diagrammatic and schematic representations of presently preferred embodiments of the invention, and are not necessarily drawn to scale. They should not be construed as limiting the scope of the invention. In general, embodiments of the invention are directed to a method and apparatus for reducing mechanical and thermal stresses on a window used in an x-ray tube. Further, the window is designed so as to allow x-rays generated within the x-ray tube to exit the x-ray tube with a minimum amount of attenuation at the window.

Figure 3A:
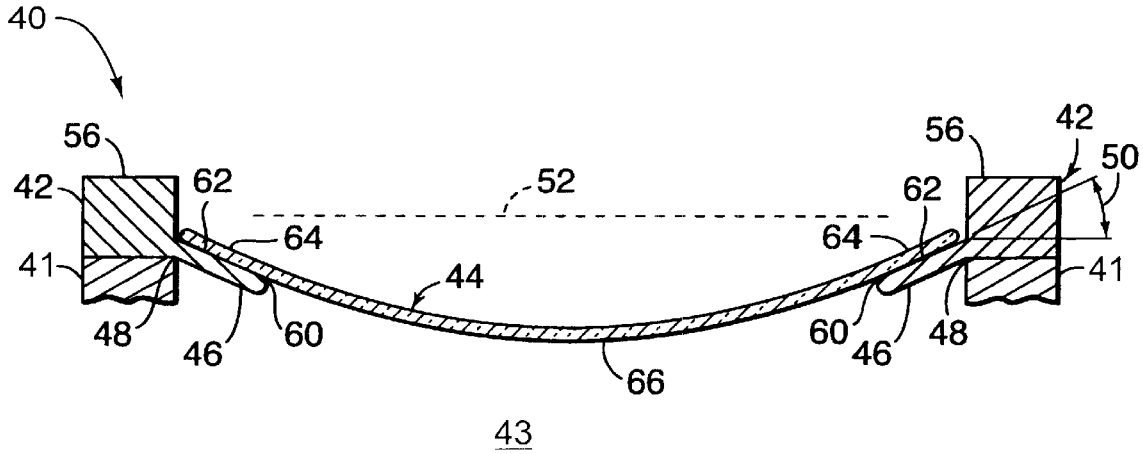
FIG. 3A is a cross-sectional illustration of a presently preferred embodiment of the present invention, wherein a window frame support flange and a window are angled to thereby reduce stresses thereon.

Reference is first made to FIG. 3A, which is an illustration of a presently preferred embodiment of a portion of housing 41 of x-ray tube 40, a modified window frame 42, and a window 44 conformingly disposed in the modified window frame so as to assume a deflected configuration.

Figure 3B:
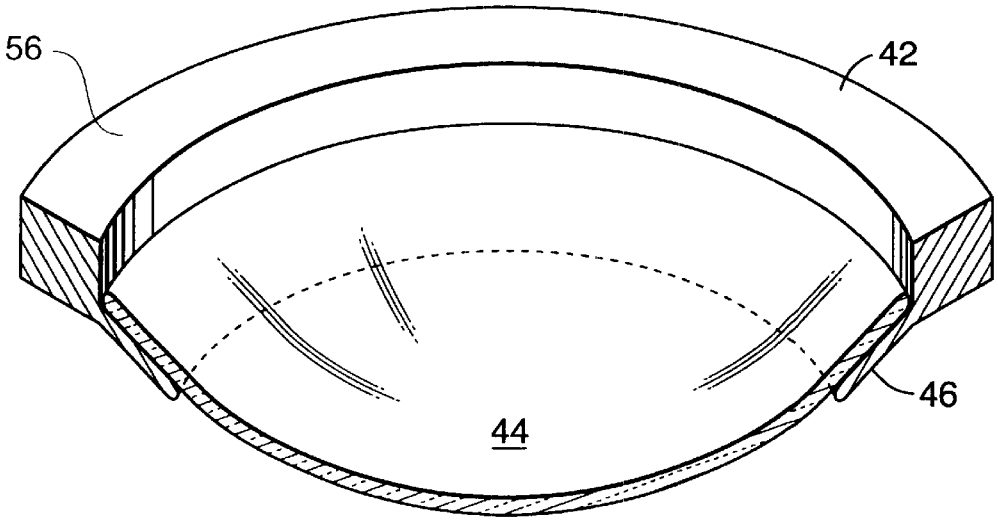
FIG. 3B is a partial cross-sectional perspective view of the embodiment of FIG. 3A showing the generally frustroconical orientation of the support flange of the window frame.

In this embodiment, the window frame 42 is comprised of an outer annular rim 56, formed as an annular ring, and a support flange 46, formed as an inner circular lip. The annular rim is preferably formed of metal or metal alloy, which can be affixed to the housing 41. The support flange 46 is formed along the inside surface of the annular rim 56, and extends towards the center of the ring formed by the window frame 42. Further, the support flange 46 is oriented at a predetermined angle 50 at its juncture 48 with rim 56 away from a plane 52 containing the window frame 42, i.e., toward the interior of the evacuated enclosure 43. The deflection angle 50 can be determined by several factors that are outlined in further detail below. FIG. 3B further illustrates that, in this presently preferred embodiment, the inwardly-angled support flange 46 generally defines a frustroconical shape.

The support flange 46 is preferably comprised of stainless steel, Monel (a copper and nickel alloy), nickel, or other metals and alloys of similar characteristic strength.

With continuing reference to FIGS. 3A and 3B, the illustrated support flange 46 includes a relatively smooth attachment surface 62 to which may be brazed, diffusion bonded, or otherwise affixed an x-ray transmissive window 44. The attachment of the window to the attachment surface is performed so as to form a vacuum seal therebetween. Both components thereby form a portion of housing 41, which housing defines evacuated enclosure 43. Materials from which windows are fabricated include, but are not limited to, beryllium, titanium, nickel, carbon, silicon, aluminum, MYLAR™, and polyethylene.

Before attaching it to the attachment surface of the support flange, the window 44 is preferably shaped in a convex downward direction to form a generally bowl-like shape. The extent to which window 44 is pre-shaped at this point is less than what its final shape will be. This is because further bending of the window will occur during a later air bake portion of the manufacturing process, as explained in detail below. The window at this point in the tube manufacturing process is therefore referred to as "undershaped."

The undershaped window 44, after it is coupled in accordance with the present invention to window frame 42, is divided into two sections. A first section 64 of window 44 that is in contact with the attachment surface 62 of the support flange 46 conforms precisely, in this preferred embodiment, with the flanges frustroconical shape. A second section 66 of the window 44 is not in contact with support flange 46. This portion forms an arcuate angle and can best be described three dimensionally as conforming to a portion of a surface of a sphere, spheroid or other surface of revolution bisected by an off-center plane. Examples of such surfaces of revolution include an ellipse, parabola, hyperbola, dome, etc.

Figure 1A:
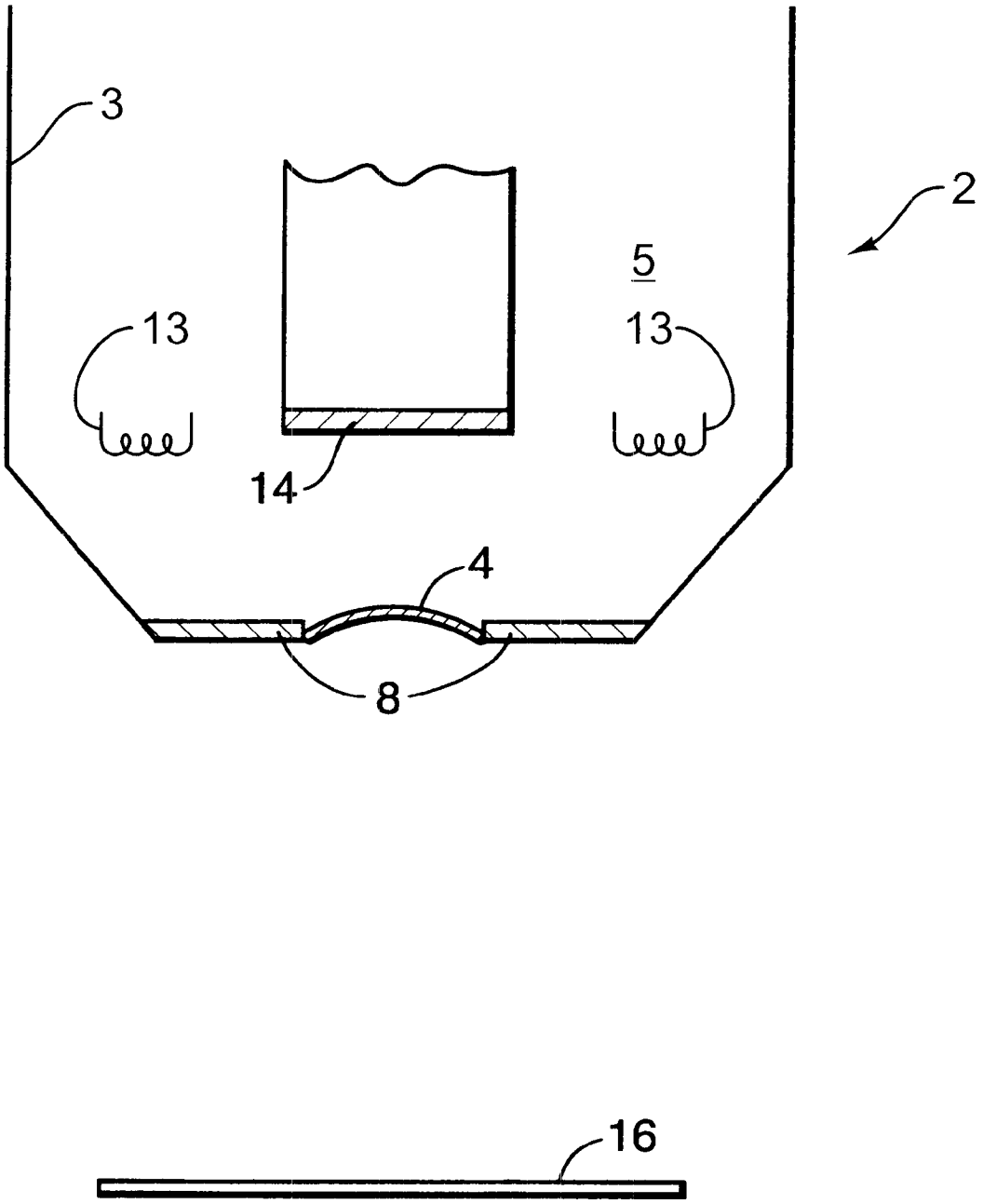
FIG. 1A (PRIOR ART)
FIG. 1A is a simplified cross-sectional profile of one example of an x-ray tube as used in the prior art showing a window situated in the end of the x-ray tube housing.
Figure 1B:
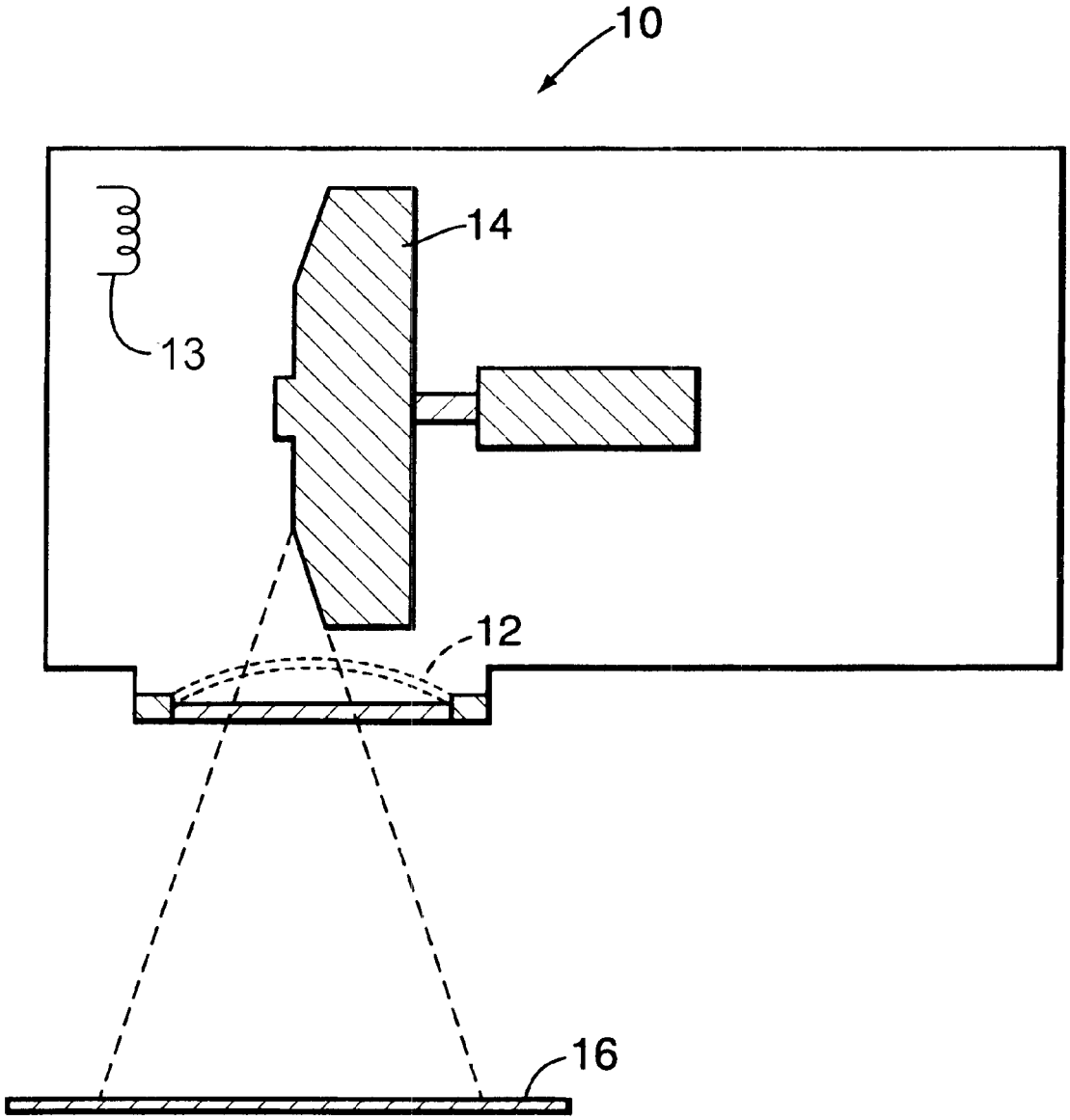
FIG. 1B (PRIOR ART)
FIG. 1B is a simplified cross-sectional illustration of another example of an x-ray tube as used in the prior art which has a window positioned in the side of the x-ray tube housing.
Figure 2A:
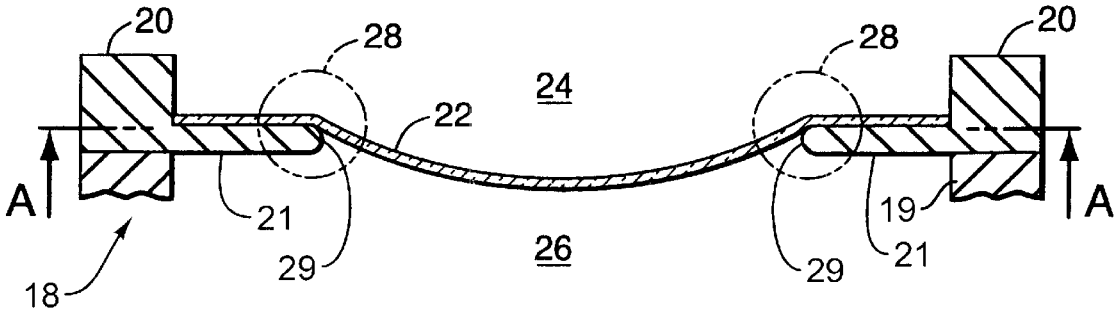
FIG. 2A (PRIOR ART)
FIG. 2A is a close-up cross-sectional illustration of an exemplary window frame as used in the prior art that secures the window in the x-ray tubes of both FIGS. 1A and 1B.
Figure 2B:
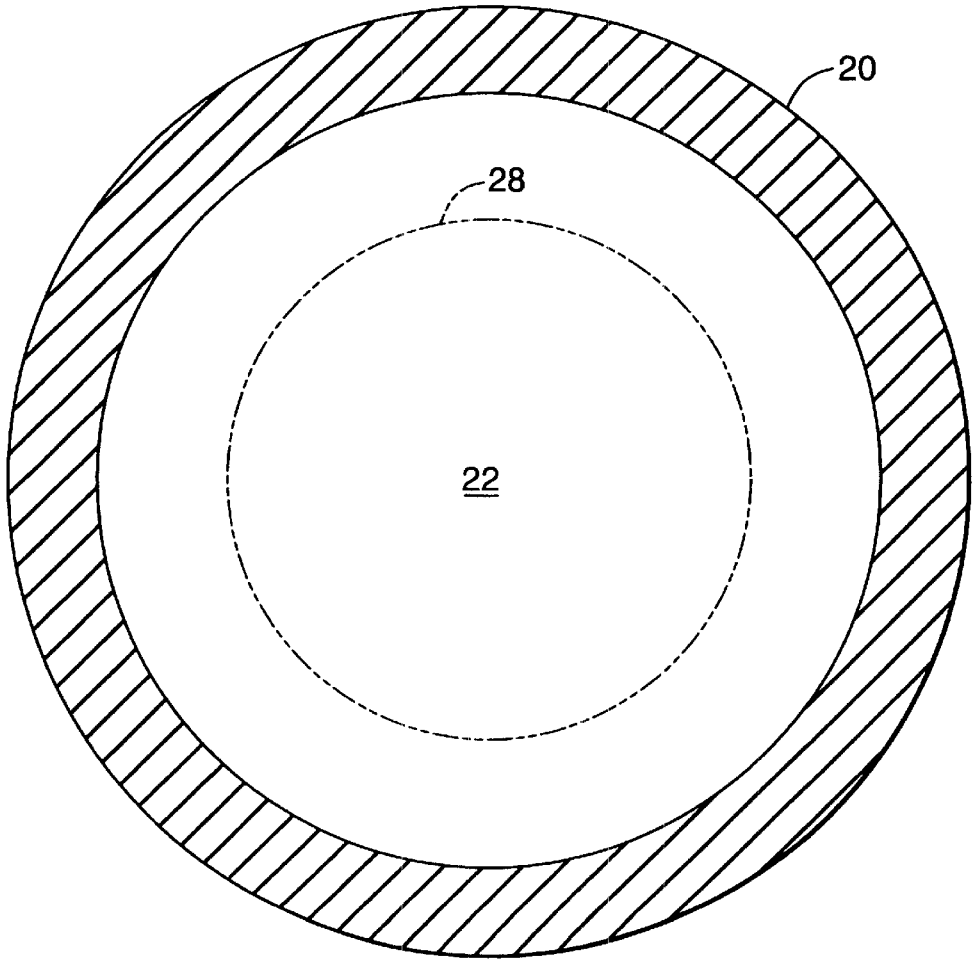
FIG. 2B (PRIOR ART)
FIG. 2B is a view of the window of FIG. 2A as seen along the lines A—A.

As mentioned earlier, during the tube manufacturing process an undershaped window 44 is first brazed or bonded to attachment surface 62 portion of the window frame 42. The frame and window are then attached to the x-ray tube housing 41 to form the evacuated enclosure 43. As a further step in the preferred manufacturing process, the x-ray tube housing 41 is then air baked at an elevated temperature. During the bake, the outer surface (i.e., the exterior of the tube housing) of window 44 is at ambient air pressure. Its interior surface, however, is exposed to the vacuum of the evacuated enclosure 43. This pressure gradient incident on the window, together with the high baking temperatures, causes undershaped window 44 to creep further inward towards the evacuated interior. Because of the designed undershaping of the window in this preferred manufacturing method, the inward creeping bends the window further, as demonstrated in FIGS. 3A and 3B, into a window orientation 66 in which destructive deforming stresses are eliminated. Once the air-bake process is complete, the resulting window 44 is not subjected to the undesirable deformation at inner edge 60 of attachment surface 62, as shown in FIG. 3A. The window is still deflected inward toward evacuated enclosure 43, but there is no longer any substantial bending at inner edge 60 where the window is no longer supported by the support flange 46, as was the case in prior art implementations. Accordingly, whereas the window of the prior art was subjected to destructive deformation stresses at the inner edge of support flange 46 (designated at point 28 of FIG. 2A), the angled support flange in the embodiment of FIGS. 3A and 3B effectively eliminates such stresses. Therefore, the only significant forces that remain at the inner edge of the support flange (designated at point 60 of FIG. 3A), e.g., tensional forces, are directed substantially parallel with the surface of window 44. These remaining forces are much less likely to result in destructive cracking of the window 44.

With continued reference to FIGS. 3A and 3B, an appropriate angle 50 must is selected for the inward orientation of support flange 46 relative to plane 52 of the window frame, so as to eliminate the bending/deflection stresses on window 44. Factors that should be considered in determining angle 50 include the thickness of the window being used, the material composition of the window, the diameter of the window frame, the manufacturing process used to produce the window, the composition of the window frame, and the process used to attach the window to the window frame. These factors notwithstanding, angle 50 preferably ranges between 0 and 15 degrees of deflection from plane 52, though it will be appreciated that other angular orientations of support flange 46 are possible while still residing within the scope of the present invention.

For the purpose of providing an illustrative example, a beryllium window was prepared, having a thickness of approximately 0.08 millimeters, a diameter of approximately 2 cm, and being subjected to an air-bake manufacturing process. An experimental angle of approximately 7 degrees for the window resulted in substantially no bending/deflection stresses at inner edge 60. Experimentation through modification of the factors listed above should result in an optimized angle 50 for the particular factors selected.

It is appreciated that, while the presently preferred embodiment utilizes a window whose primary component is beryllium, the principles of the present claimed invention can also be applied to windows composed of different materials. For example, x-ray transmissive window materials including titanium, nickel, carbon, silicon, aluminum MYLAR™ and polyethylene could be employed. Such other window materials, therefore, are contemplated as falling under the claims of the present invention.

One advantage of the angled window frame of the preferred embodiment is that a thinner window can be utilized. This is possible because less stress is induced upon the window, thus eliminating the need for stronger, bulkier window materials. Thinner windows also equate to a corresponding increase in the transmissivity of lower energy x-rays through the window. This makes the x-ray tube more efficient by increasing its ability to emit x-rays at a given operating power.

Figure 4:
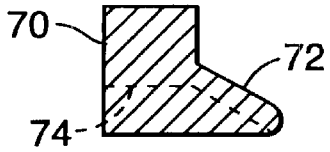
FIG. 4 is a cross-sectional view of another embodiment of a window frame and support flange.

The description above is primarily addressed to a presently preferred embodiment of the invention. However, there are alternative embodiments of the invention. For example, FIG. 4 depicts an alternative embodiment of the window frame 70. Specifically, the shape of window frame 70 may be modified to strengthen the support flange 72 by adding additional thickness to it. For example, the contours of the window frame and the support flange in the embodiment of FIG. 3A and 3B are shown by dotted line 74 in order to illustrate the material that is added to the window frame in this embodiment.

In another alternative embodiment, attachment surface of the window frame defines a smooth arcuate surface whereupon the x-ray tube window is attached. This alternative surface generally resembles a portion of a surface of rotation. Accordingly, that surface of rotation can be parabolic, elliptical, hyperbolic, etc. Such an embodiment may be desirable to accommodate the materials being used to manufacture the window, a pre-use shape of the window, or even limitations of the window frame itself.

Figure 5:
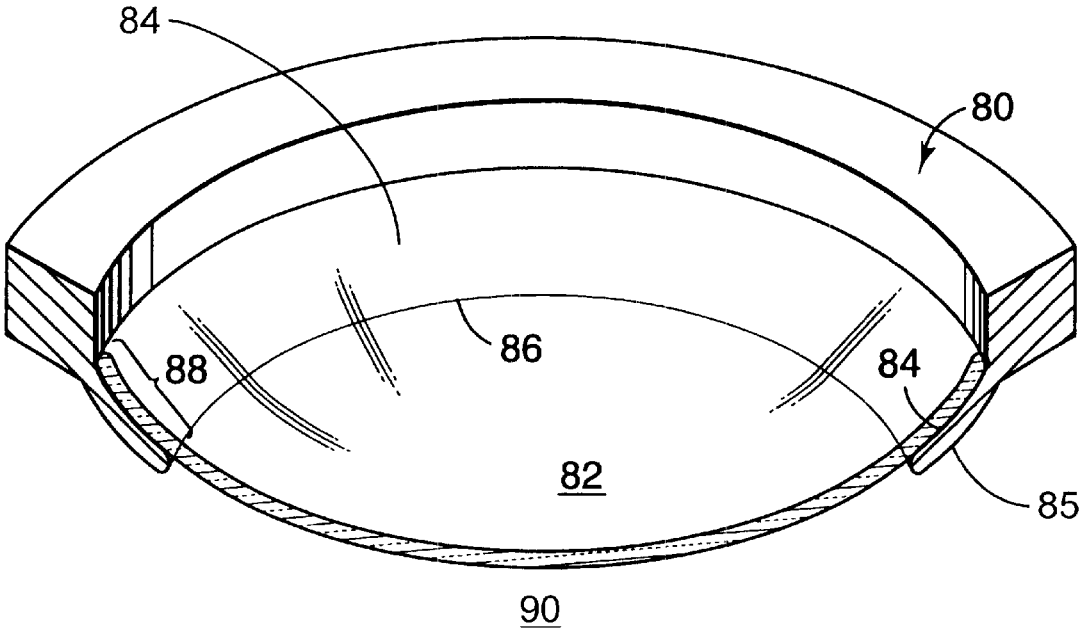
FIG. 5 is a partial cross-sectional perspective view of yet another embodiment of a window and window frame.

FIG. 5 depicts such an alternative embodiment of a window frame 80 and window 82, where the attachment surface 84 of support flange 85 forms a generally arcuate shape along the length 88 extending from the juncture of the support flange 85 with the body of frame 80 to inner diameter 86 of the support flange, and preferably is at least partially concavely shaped upward away from evacuated enclosure 90. Window 82 of this alternative embodiment is attached in the same manner as detailed in the preferred embodiment above.

Figure 6:
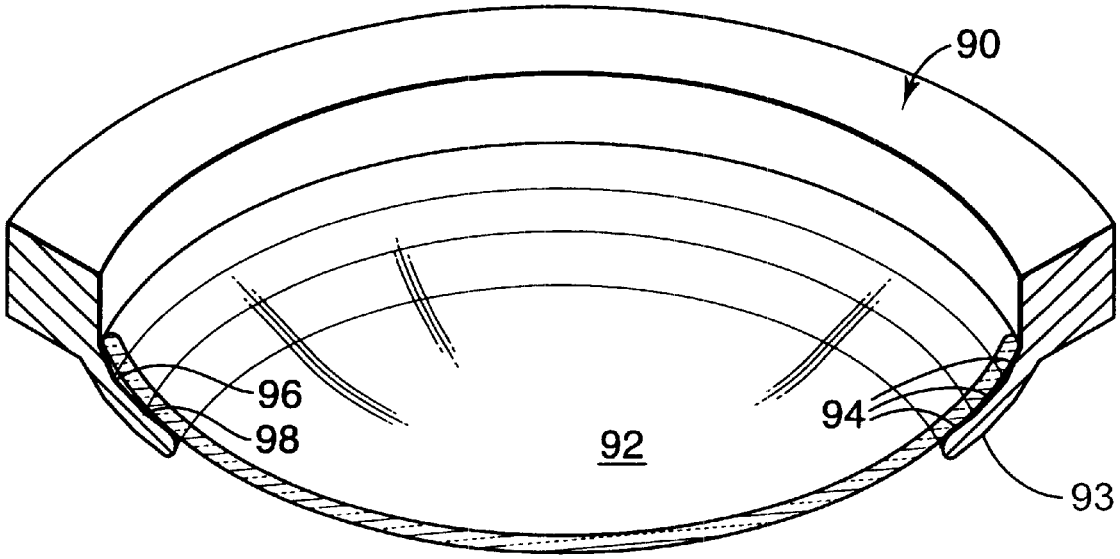
FIG. 6 is a partial cross-sectional perspective view of another embodiment of a window and window frame showing a support flange of the window frame having a disjointed, multi-angled shape.

FIG. 6 depicts yet another alternative embodiment, where an attachment surface defines a concavely-shaped, multiply-angled or stepped surface to which the x-ray tube window is attached. In FIG. 6, window frame 90 and window 92 are depicted, and it is shown how attachment surface 94 of support flange 93 is formed with multiple step surfaces formed at angles along the support flange 93. For example, two such angles, 96 and 98, are shown defined on attachment surface 94 of the support flange. This alternative embodiment may be useful in the attachment of windows to window frames by providing a plurality of frustroconical sections to which portions of the window may more easily be adhered.

It is appreciated that, while the attachment surfaces of the various embodiments disclosed herein feature smooth surfaces to which the window attaches, the attachment surface may be roughened to assist in the adhesion of the window thereto. Attachment surfaces of a variety of reliefs therefore are contemplated as residing within the claims of the present invention.

Figure 7:
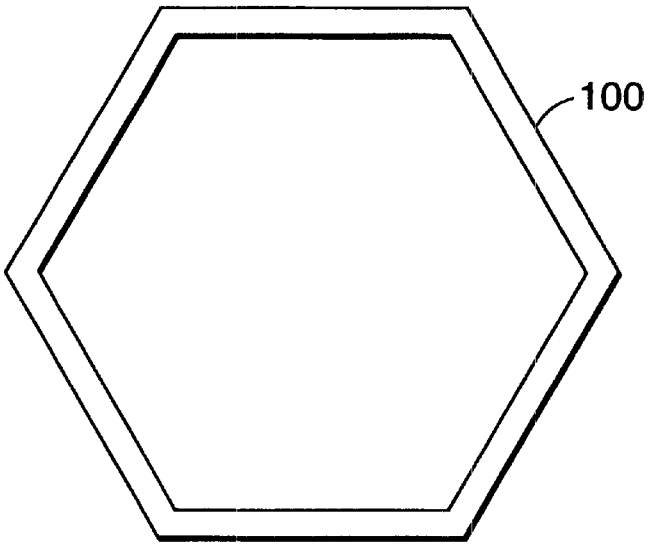
FIG. 7 is a top view of the outline of a window frame depicting one of the various window frame configurations that are contemplated within an alternative embodiment of the present invention.

FIG. 7 is a plan view of the outline of a window frame 100. It is recognized that the shape of the window frame is not limited to a circle as described in the previous embodiments. The window frame 100 can be any shape into which a window can be inserted. For example, the window frame of FIG. 7 comprises a hexagonal shape. Accordingly, the shape of the x-ray tube window of the present invention may comprise any ellipsoid or polygon that does not interfere with the purposes of the device in which the window frame is disposed. Limitations to the window frame shape may be imposed, however, by such things as the material being used for the window, or the purposes of the x-ray generating device.

The present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A window frame for securing a window in the evacuated housing of an x-ray tube, the window frame comprising:

an outer rim affixed to a wall of the evacuated housing; and a flange formed at least partially along an inner surface of the outer rim, wherein the flange is formed at an angle with respect to the outer rim so as to project inwardly towards an interior of the evacuated housing, the flange also comprising an inner edge that defines an aperture through the evacuated housing.

2. A window frame as defined in claim 1, wherein the flange defines a frustroconical depression having a largest diameter where the flange is joined to the outer rim, and having a smallest diameter at the inner edge of the flange that extends inward toward the x-ray tube.

3. A window frame as defined in claim 2, wherein the flange further comprises an attachment surface for attachment of a window thereto, said window covering the aperture.

4. A window frame as defined in claim 1, wherein the outer rim and the flange are formed as a single integral piece.

5. A window frame as defined in claim 3, wherein the window is brazed to the attachment surface.

6. A window frame as defined in claim 3, wherein the window is diffusion bonded to the attachment surface.

7. A window frame as defined in claim 3, wherein the window is coupled to the attachment surface in a manner such that the window is characterized by the absence of an abrupt change in surface continuity.

8. A window frame as defined in claim 1, wherein the outer rim comprises an annular rim.

9. A window frame as defined in claim 1, wherein the flange comprises an annular flange.

10. A window frame as defined in claim 1, wherein the outer rim and the flange are formed having perimeters that are ellipsoids.

11. A window frame as defined in claim 1, wherein the outer rim and the flange are formed having perimeters that are polygons.

12. A window frame as defined in claim 1, wherein the flange is formed at an angle ranging from 0 to 4 degrees.

13. A window frame as defined in claim 3, wherein the attachment surface of the flange forms a substantially arcuate shape.

14. A window frame as defined in claim 3, wherein the attachment surface comprises a plurality of discrete stepped surfaces.

15. A window frame as defined in claim 7 wherein the material for the window is selected from a group of materials consisting of beryllium, titanium, nickel, carbon, silicon, aluminum, MYLAR (TM) and polyethylene.

16. An x-ray tube comprising:

an evacuated housing defining evacuated enclosure containing an electron source and an anode, said evacuated housing having a aperture formed therein through which x-rays are directed;

a window frame comprising an outer rim coupled to the evacuated housing over the aperture; and a lip formed on an inner surface of the outer rim, wherein the lip forms an attachment surface that is angled away from the plane of the window frame and inward toward the interior of the evacuated enclosure.

17. An x-ray tube as defined in claim 16, wherein the attachment surface of the lip defines a frustroconical depression having a largest diameter where the lip is joined to the outer rim, and decreasing in diameter as the lip extends inward toward the interior of the evacuated enclosure.

18. An x-ray tube as defined in claim 16, wherein the attachment surface is formed with a plurality of discrete stepped surfaces.

19. An x-ray tube as defined in claim 16, wherein the rim and the lip of the window frame are formed as an integral piece.

20. An x-ray tube as defined in claim 16, wherein the angle between the attachment surface and the plane of the window frame is between 0 and 15 degrees.

21. An x-ray tube comprising:

an evacuated housing defining and evacuated enclosure having an electron source and anode disposed therein, the evacuated housing defining a aperture through which x-rays are directed;

an annular window frame coupled to the evacuated housing about the perimeter of the aperture, the annular window frame including a support flange defining an attachment surface that is angled inward towards the interior of the evacuated enclosure; and a disk-shaped, x-ray transmissive beryllium window disposed in the annular window frame and affixed to the attachment surface such that a vacuum seal is formed between the window frame and window, said beryllium window depressed about its center point so as to be deflected inward towards the interior of the evacuated enclosure, thereby reducing deflection stresses in the region where the beryllium window is coupled to the annular lip.

22. An x-ray tube as defined in claim 21, wherein the attachment surface has a curved shape.

23. An x-ray generating device for reducing deflection stresses on a beryllium window mounted therein, the x-ray generating device comprising:

a window frame comprising an outer circular rim forming a ring, said outer circular rim coupled to the x-ray generating device;

an inner circular lip formed on an inner surface of the outer circular rim, said inner circular lip angled away from the plane of the window frame, and inward toward the interior of the x-ray generating device, said inner circular lip also comprising an attachment surface; and a beryllium window coupled to the attachment surface such that the beryllium window is characterized by an absence of an abrupt change in surface continuity where the beryllium window transitions to no longer being in direct contact with the attachment surface.

24. A window assembly suitable for use in conjunction with an evacuated housing of an x-ray device, the window assembly comprising:

a window frame that defines an opening and includes:

an outer rim configured to be joined to the evacuated housing; and a flange attached to the outer rim and cooperating with the outer rim to define an oblique angle; and a window attached to the flange of the window frame so as to substantially block the opening, the window having a first side arranged to be exposed to atmospheric pressure, and a second side arranged to be exposed to a vacuum within the evacuated housing.

25. The window assembly as recited in claim 24, wherein the first side of the window is concave and the second side of the window is convex.

26. The window assembly as recited in claim 24, wherein the oblique angle cooperatively defined by the flange and the evacuated housing is greater than about ninety degrees.

27. The window assembly as recited in claim 24, wherein the flange is integral with the outer rim of the window frame.

28. The window assembly as recited in claim 24, wherein at least that portion of the window in contact with the flange is substantially parallel to the flange.

29. The window assembly as recited in claim 24, wherein at least a portion of the window is substantially in the form of a surface of revolution.

30. The window assembly as recited in claim 24, wherein the flange generally defines a frustoconical depression.

* * * * *